US011069319B2

(12) United States Patent
Meng et al.

(10) Patent No.: US 11,069,319 B2
(45) Date of Patent: Jul. 20, 2021

(54) VIDEO PLAYING METHOD, DEVICE AND STORAGE MEDIUM

(71) Applicants: Beijing BOE Optoelectronics Technology Co., Ltd., Beijing (CN); BOE Technology Group Co., Ltd., Beijing (CN)

(72) Inventors: Zhaohui Meng, Beijing (CN); Wei Sun, Beijing (CN); Wenchao Han, Beijing (CN); Lin Cong, Beijing (CN)

(73) Assignees: BEIJING BOE OPTOELECTRONICS TECHNOLOGY CO., LTD., Beijing (CN); BOE TECHNOLOGY GROUP CO., LTD., Beijng (CN)

( * ) Notice: Subject to any disclaimer, the term of this patent is extended or adjusted under 35 U.S.C. 154(b) by 0 days.

(21) Appl. No.: 16/639,157

(22) PCT Filed: Jun. 18, 2019

(86) PCT No.: PCT/CN2019/091727
§ 371 (c)(1),
(2) Date: Feb. 14, 2020

(87) PCT Pub. No.: WO2020/001326
PCT Pub. Date: Jan. 2, 2020

(65) Prior Publication Data

US 2020/0234671 A1 Jul. 23, 2020

(30) Foreign Application Priority Data

Jun. 29, 2018 (CN) ..... 201810712699.2

(51) Int. Cl.
*G09G 5/36* (2006.01)
*G09G 5/00* (2006.01)

(52) U.S. Cl.
CPC ..... *G09G 5/001* (2013.01); *G09G 2320/0247* (2013.01); *G09G 2320/10* (2013.01)

(58) Field of Classification Search
CPC ..... G09G 2340/0435; G09G 5/363; G09G 2320/0613; G09G 2370/04; G09G 3/3618; G09G 5/18; G09G 3/3611; H04N 21/4307
See application file for complete search history.

(56) References Cited

U.S. PATENT DOCUMENTS

2007/0057952 A1 3/2007 Swedberg et al.
2012/0113166 A1* 5/2012 Murakami ..... G09G 3/342 345/690

(Continued)

FOREIGN PATENT DOCUMENTS

CN 103064644 A 4/2013
CN 105741753 A 7/2016

(Continued)

OTHER PUBLICATIONS

International search report of PCT application No. PCT/CN2019/091727 dated Sep. 18, 2019.

(Continued)

*Primary Examiner* — Hau H Nguyen
(74) *Attorney, Agent, or Firm* — Fay Sharpe LLP

(57) ABSTRACT

The present disclosure provides a video playing method, device and storage medium. The method includes: obtaining a target video which comprises a plurality of video frames arranged in sequence, and sending sequentially the plurality of video frames to a display module, by a graphics processing unit; for each video frame, receiving and playing the video frame for a target duration from a start moment of receiving the video frame, by the display module; wherein target durations for which the display module plays at least two video frames in the target video are not equal. The (Continued)

technical solutions provided in the embodiments of the present disclosure can improve the refresh rate of a video.

18 Claims, 8 Drawing Sheets

(56) References Cited

U.S. PATENT DOCUMENTS

| | | | | |
|---|---|---|---|---|
| 2016/0275916 | A1 | 9/2016 | Glen et al. | |
| 2016/0381255 | A1 | 12/2016 | Huang et al. | |
| 2017/0053620 | A1 | 2/2017 | Law et al. | |
| 2017/0352322 | A1* | 12/2017 | Spence | G09G 5/12 |
| 2018/0061364 | A1* | 3/2018 | Cook | G09G 5/006 |
| 2018/0268512 | A1* | 9/2018 | Pronovost | G06T 1/20 |

FOREIGN PATENT DOCUMENTS

| | | | |
|---|---|---|---|
| CN | 106296566 | A | 1/2017 |
| CN | 106303691 | A | 1/2017 |
| CN | 106559635 | A | 4/2017 |
| CN | 106816134 | A | 6/2017 |
| CN | 107748439 | A | 3/2018 |
| CN | 107924667 | A | 4/2018 |
| KR | 20160078596 | A | 7/2016 |

OTHER PUBLICATIONS

First office action of Chinese application No. 201810712699.2 dated Sep. 30, 2019.

Detailed explanation of NVDIA-Sync technology [Picture + Video] Introduction of monitors supporting G-Sync, Baidu Academic, Jan. 21, 2014; paragraphs 6-9.

* cited by examiner

VIDEO PLAYING METHOD, DEVICE AND STORAGE MEDIUM

The present application is a 371 of PCT International Application No. PCT/CN2019/091727 filed on Jun. 18, 2019, which claims priority to Chinese Patent application No. 201810712699.2, filed on Jun. 29, 2018 and titled "VIDEO PLAYING METHOD, DEVICE AND STORAGE MEDIUM", which is incorporated herein by reference in its entirety.

TECHNICAL FIELD

The present disclosure relates to a video playing method, device, and storage medium.

BACKGROUND

The video refresh rate refers to the rate at which video frames are updated on the display module, that is, the number of video frames displayed by the display module per second. The higher the refresh rate of a video, the lower the flickering feeling of the video, and the better the visual protection.

SUMMARY

Embodiments of the present disclosure provide a video playing method, device, and storage medium. The technical solutions of the embodiments of the present disclosure are as follows.

In an aspect, a video playing method is provided. The method comprises:

obtaining a target video by a graphics processing unit, the target video comprising a plurality of video frames arranged in sequence;

sending sequentially the plurality of video frames to a display module by the graphics processing unit; and for each of the video frames, receiving the video frame and playing the video frame for a target duration from a start moment of receiving the video frame, by the display module;

wherein target durations for which the display module plays at least two video frames in the target video are not equal.

Optionally, for each of the video frames, the target duration is positively correlated to a duration for which the graphics processing unit completely sends the video frame to the display module.

Optionally, for each of the video frames, the target duration is equal to a sum of a fixed duration and the duration for which the graphics processing unit completely sends the video frame to the display module, the fixed duration being equal for the plurality of video frames.

Optionally, sending sequentially the plurality of video frames to the display module by the graphics processing unit comprises:

for each of the video frames, sending the video frame to the display module by the graphics processing unit, and sending a next video frame following the video frame to the display module by the graphics processing unit after the target duration has elapsed from a start moment of sending the video frame.

Optionally, for each of the video frames, sending the video frame to the display module by the graphics processing unit, and sending the next video frame following the video frame to the display module by the graphics processing unit after the target duration has elapsed from the start moment of sending the video frame comprises:

for each of the video frames, sending the video frame to the display module by the graphics processing unit, and sending the next video frame following the video frame to the display module by the graphics processing unit when a fixed duration has elapsed from a moment when the video frame is completely sent to the display module.

Optionally, the method further comprises:

for each of the video frames, after the target duration has elapsed from the start moment of sending the video frame, generating a synchronization signal and sending the synchronization signal to the display module by the graphics processing unit, the synchronization signal being configured to instruct the display module to receive the next video frame following the video frame and to play the next video frame for the target duration from a start moment of receiving the next video frame.

Optionally, the method further comprises:

for each of the video frames, receiving, by the display module, the next video frame after receiving the synchronization signal, and playing, by the display module, the next video frame for the target duration from a moment of receiving the synchronization signal.

Optionally, the target duration is equal to a sum of a fixed duration and a duration for which the graphics processing unit completely sends the video frame to the display module; and when the display module is a liquid crystal display module, the fixed duration is determined according to a duration of gesture transformation of a liquid crystal.

Optionally, the target duration is equal to a sum of a fixed duration and a duration for which the graphics processing unit completely sends the video frame to the display module; and when the display module is a light emitting diode display module, the fixed duration is determined according to a duration of grayscale conversion of a light emitting diode.

Optionally, prior to sending sequentially the plurality of video frames to the display module by the graphics processing unit, the method further comprises: for each of the video frames, rendering the video frame by the graphics processing unit; and sending sequentially the plurality of video frames to the display module by the graphics processing unit comprises: sending sequentially the plurality of rendered video frames to the display module by the graphics processing unit.

In another aspect, a video playing device is provided. The device comprises a graphics processing unit and a display module, wherein the graphics processing unit is configured to obtain a target video which comprises a plurality of video frames arranged in sequence, and send sequentially the plurality of video frames to the display module; and the display module is configured to, for each of the video frames, receive the video frame and play the video frame for a target duration from a start moment of receiving the video frame;

wherein target durations for which the display module plays at least two video frames in the target video are not equal.

Optionally, for each of the video frames, the target duration is positively correlated to a duration for which the graphics processing unit completely sends the video frame to the display module.

Optionally, for each of the video frames, the target duration is equal to a sum of a fixed duration and the duration for which the graphics processing unit completely sends the video frame to the display module, and the fixed duration is equal for the plurality of video frames.

Optionally, the graphics processing unit is configured to, for each of the video frames, send the video frame to the display module, and send a next video frame following the video frame to the display module after the target duration has elapsed from a start moment of sending the video frame.

Optionally, the graphics processing unit is configured to, for each of the video frames, send the video frame to the display module, and send the next video frame following the video frame to the display module when a fixed duration has elapsed from a moment when the video frame is completely sent to the display module.

Optionally, the graphics processing unit is further configured to, for each of the video frames, after the target duration has elapsed from the start moment of sending the video frame, generate a synchronization signal and send the synchronization signal to the display module, the synchronization signal being configured to instruct the display module to receive the next video frame following the video frame and to play the next video frame for the target duration from a start moment of receiving the next video frame.

Optionally, the display module is further configured to, for each of the video frames, receive the next video frame after receiving the synchronization signal, and play the next video frame for the target duration from a start moment of receiving the synchronization signal.

Optionally, the target duration is equal to a sum of a fixed duration and a duration for which the graphics processing unit completely sends the video frame to the display module; and when the display module is a liquid crystal display module, the fixed duration is determined according to a duration of the gesture transformation of a liquid crystal.

Optionally, the target duration is equal to a sum of a fixed duration and a duration for which the graphics processing unit completely sends the video frame to the display module; and when the display module is a light emitting diode display module, the fixed duration is determined according to a duration of grayscale conversion of a light emitting diode.

Optionally, the graphics processing unit is further configured to, for each of the video frames, render the video frame, and sequentially send the plurality of rendered video frames to the display module.

In yet another aspect, a computer-readable storage medium is provided. A computer program is stored in the computer-readable storage medium, and the computer program, when executed, performs the video playing method in the above aspect.

BRIEF DESCRIPTION OF THE DRAWINGS

To describe the technical solutions in the embodiments of the present disclosure more clearly, the following briefly introduces the accompanying drawings required for describing the embodiments. Apparently, the accompanying drawings in the following description show merely some embodiments of the present disclosure, and a person of ordinary skill in the art may still derive other drawings from these accompanying drawings without creative efforts.

DETAILED DESCRIPTION

Embodiments of the present disclosure will be described in further detail with reference to the accompanying drawings, to present the principles, technical solutions, and advantages of the present disclosure more clearly.

The refresh rate of a video refers to the rate at which video frames are updated on a display module. Generally, the higher the refresh rate of a video, the lower the flickering feeling of the video, and the better the visual protection.

In a Virtual Reality (VR) head-mounted display, the level of video refresh rate is closely related to the possibility of motion sickness of users. Motion sickness is a disease that occurs when users watch videos using a VR head-mounted display. Motion sickness can cause users to experience epigastric discomfort, nausea, pale complexion, cold sweats, dizziness, mental depression, increased saliva secretion, and vomiting and other symptoms, which can greatly affect the comfort of using a VR HMD head-mounted display.

Generally, when the refresh rate of a video is low, the delay of the video may be perceived by the user. When the delay of the video is perceived by the user, the vestibular nerve of the user will be stimulated, and then the user will experience motion sickness. For example, when the user's head rotates 90 degrees to the right within 0.5 second, the VR head-mounted display shows the user a picture that has rotates 90 degrees to the right. However, if the refresh rate of the video in the VR head-mounted display is low, the time required by the VR head-mounted display to display the image that has rotates 90 degrees to the right would be greater than 0.5 second. If this time difference is perceived by the user, the vestibular nerve of the user would be stimulated, and then the user would feel dizzy and experience motion sickness.

Therefore, increasing the refresh rate of the video is of great significance to the protection of the user's vision and to prevent the occurrence of motion sickness.

As known by the inventor, a display device generally includes a display module and a graphics processing unit (GPU). When playing a video, the GPU may send video frames in the video one by one to the display module, to be played by the display module. The display module usually plays the respective video frames in the video for the same duration. For example, if the video refresh rate is 60 Hz (hertz), the playing duration for each of the video frames by the display module is 16.6 ms (milliseconds). When the playing duration for a video frame ends, the GPU may send the next video frame following the video frame to the display module, to be played by the display module.

Figure 1:
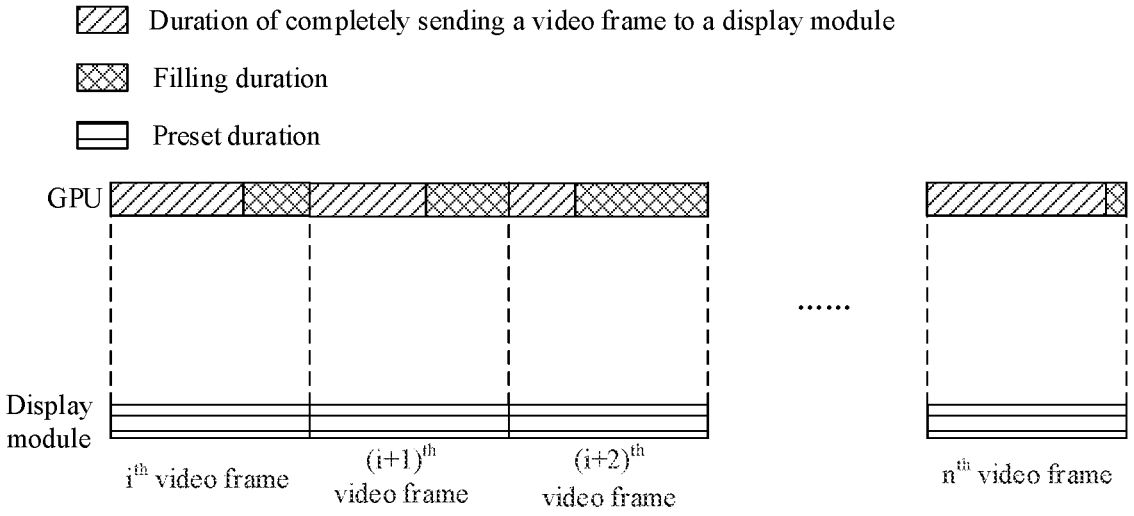
FIG. 1 is a schematic diagram of a video playing method known by the inventor.

Exemplarily, FIG. 1 illustrates a schematic diagram of a video playing method known by the inventor. In FIG. 1, it's assumed that a video includes n video frames (n is an integer greater than 3). For each video frame in the video (e.g., the $i^{th}$ video frame, i is an integer greater than or equal to 1 and less than n), the GPU may send the video frame to the display module, and the display module may receive the video frame sent by the GPU and play the video frame for a preset duration. After the GPU completely sends the video frame to the display module, if the preset duration for which the display module plays the video frame has not elapsed (that is, the display module has been playing the video frame for a duration less than the preset duration), the GPU may wait for a certain duration until the preset duration elapses. This certain duration can be referred to as a blanking duration. When the preset duration for which the display module plays the video frame elapses, the GPU may send the next video frame (e.g., the $(i+1)^{th}$ video frame) following the video frame to the display module. After receiving the next video frame video frame) sent by the GPU, the display module may stop playing the currently played video frame (e.g., the $i^{th}$ video frame), and plays the next video frame for the preset duration. Similarly, after the GPU completely sends the next video frame to the display module, if the preset duration for which the display module plays the next video frame has not elapsed, the GPU may wait for a certain duration until the preset duration elapses, and sends the further next video frame (e.g., the $(i+2)^{th}$ video frame) following the next video frame to the display module when the preset duration elapses, and so on.

From the above description, it is not difficult to understand that in the video playing method known by the inventor, the duration for which the display module plays each video frame is a preset duration, and the durations for which the display module plays all the video frames in a video are equal. However, the durations required by the GPU to completely send different video frames to the display module are generally not equal. For example, for two adjacent video frames (e.g., the $i^{th}$ video frame and the $(i+1)^{th}$ video frame), when the contents of the two video frames differ slightly, the duration required by the GPU to completely send the latter video frame (e.g. the $(i+1)^{th}$ video frame) to the display module is generally shorter than the duration required by the GPU to completely send the previous video frame (e.g., the $i^{th}$ video frame) to the display module, that is, the duration required by the GPU to completely send the latter video frame to the display module is relatively short. When the contents of the two adjacent video frames differ greatly, the duration required by the GPU to completely send the latter video frame (e.g. the $(i+1)^{th}$ video frame) to the display module is generally longer the duration required by the GPU to completely send the previous video frame (e.g., the $i^{th}$ video frame) to the display module, that is, the duration required by the GPU to completely send the latter video frame to the display module is relatively long. If the duration required by the GPU to completely send a certain video frame to the display module is relatively short, the GPU needs to wait a long time before sending the next video frame following the video frame to the display module, which affects the refresh rate of the video.

Embodiments of the present disclosure provide a video playing method, which can improve the refresh rate of a video. With this method, the GPU can obtain a target video and send sequentially a plurality of video frames arranged in sequence in the target video to a display module, and for each of the video frames, the display module can receive the video frame and play the video frame for a target duration from the start moment of receiving the video frame. The target durations for which the display module plays at least two video frames in the target video are not equal. In this way, the playing duration for one or more video frames in the target video played by the display module can be relatively short. Compared with the video playing method known by the inventor, the number of video frames played by the display module in the same duration can be increased, so that the display module can display more video frames in the same duration. Thus, the refresh rate of the video can be improved.

Optionally, for each of the video frames in the target video, the target duration for which the display module plays the video frame can be positively correlated to the duration for which the GPU completely sends the video frame to the display module. That is, when the duration for the GPU to completely send the video frame to the display module is relatively short, the target duration for which the display module plays the video frame is also relatively short. In this way, when the duration required by the GPU to completely send a certain video frame to the display module is relatively short, the problem that the GPU needs to waft for a long time before sending the next video frame following the video frame to the display module can be avoided, which can improve the refresh rate of the video.

The implementation environment involved in the video playing method provided in the embodiments of the present disclosure is described as follows.

Figure 2:
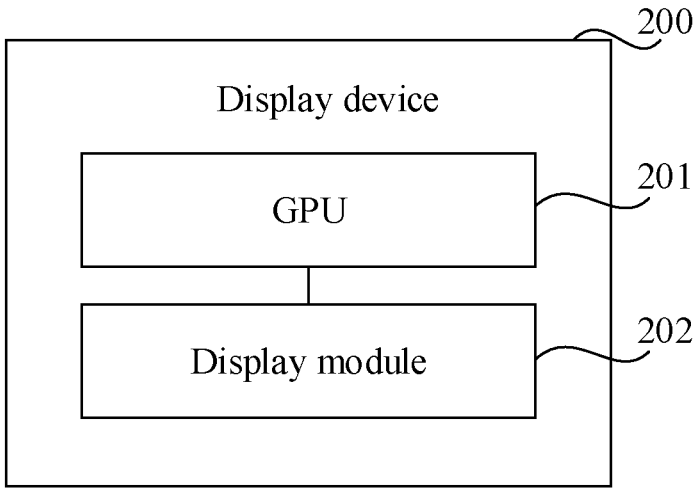
FIG. 2 is a schematic diagram of an implementation environment of a video playing method provided in an embodiment of the present disclosure.

FIG. 2 is a schematic diagram of an implementation environment involved in a video playing method provided by an embodiment of the present disclosure, and a display device 200 is provided under the implementation environment. The display device 200 may include a GPU 201 and a display module 202. A communication connection, for example, a bus connection or the like, may be established between the GPU 201 and the display module 202. The GPU 201 is configured to obtain a target video, and sequentially send a plurality of video frames in the target video to the display module 202. The display module 202 is configured to receive and play the video frames sent by the GPU 201. For each of the video frames, the display module 202 may receive the video frame and play the video frame for a target duration from the start moment of receiving the video frame, and the target durations for which the display module 202 plays at least two video frames in the target video are not equal. In this way, the playing duration for which the display module 202 plays one or more video frames in the target video can be relatively short, thereby improving the refresh rate of the video.

Figure 3:
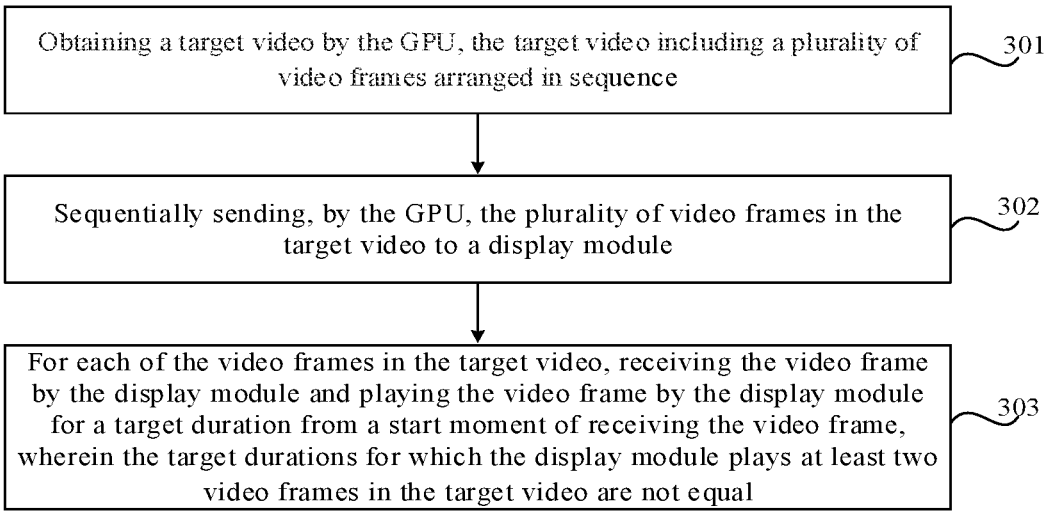
FIG. 3 is a flowchart of a video playing method provided in an embodiment of the present disclosure.

Please refer to FIG. 3, which illustrates a flowchart of a video playing method provided by an embodiment of the present disclosure. The video playing method can be applied to the display device 200 illustrated in FIG. 2. As illustrated in FIG. 3, the video playing method may include the following steps.

In step 301, the GPU obtains a target video, the target video including a plurality of video frames arranged in sequence.

In step 302, the GPU sends sequentially the plurality of video frames in the target video to a display module.

In step 303, for each of the video frames in the target video, the display module receives the video frame, and plays the video frame for a target duration from a start moment of receiving the video frame, wherein the target durations for which the display module plays at least two video frames in the target video are not equal.

Persons in the art can readily understand that the sequence of steps described in the embodiments of the present disclosure is not intended to limit the sequence of steps executed by the GPU and the display module. That is, in the embodiments of the present disclosure, the steps described earlier can be executed later, or the steps described later can be executed earlier, or the steps described earlier and the steps described later can be executed simultaneously or cross-executed, which is not limited in the embodiments of the present disclosure.

In summary, with the video playing method provided in the embodiments of the present disclosure, the GPU obtains the target video and sends sequentially a plurality of video frames arranged in sequence in the target video to the display module, and for each of the video frames, the display module receives the video frame and plays the video frame for a target duration from the start moment of receiving the video frame. The target durations for which the display module plays at least two video frames in the target video are not equal. In this way, the playing duration for one or more video frames in the target video played by the display module can be relatively short. Compared with the video playing method known by the inventor, the display module can display more video frames in the same duration. Thus, the refresh rate of the video can be improved.

Figure 4:
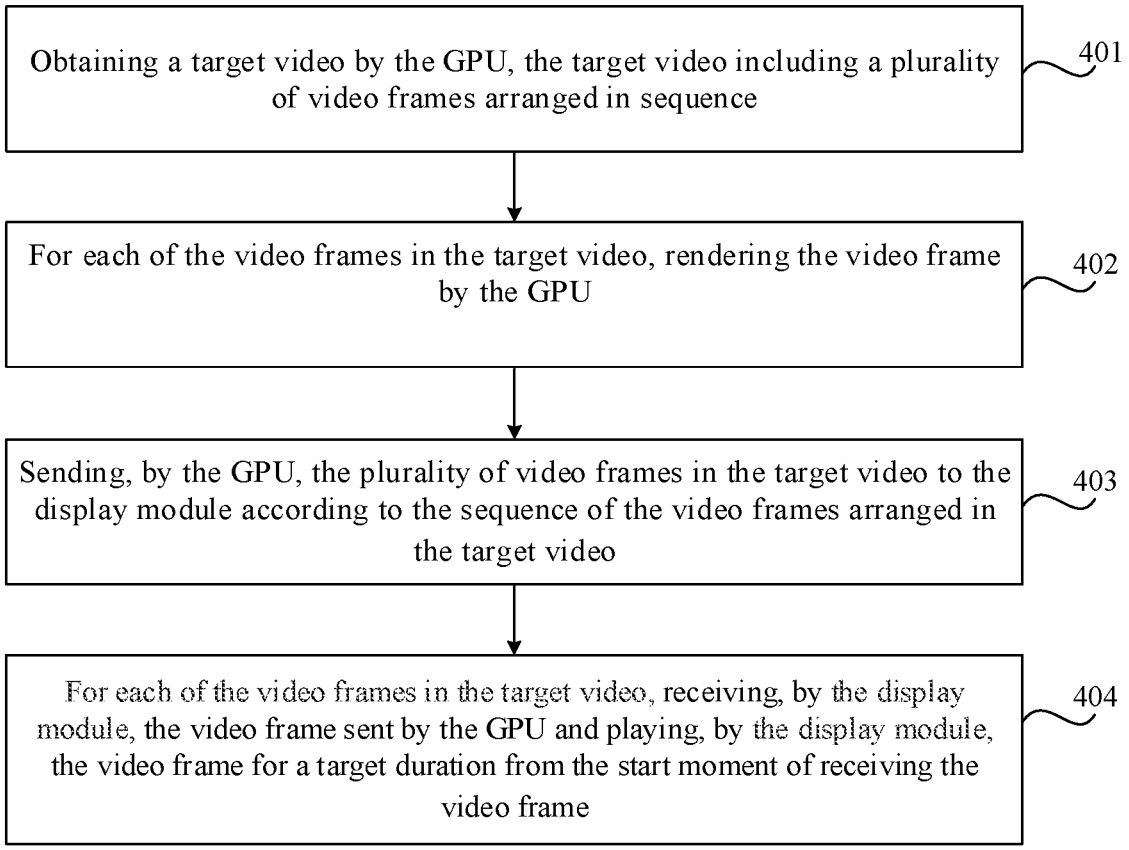
FIG. 4 is a flowchart of another video playing method provided in an embodiment of the present disclosure.

Please refer to FIG. 4, which illustrates a flowchart of another video playing method provided by an embodiment of the present disclosure. The video playing method can be applied to the display device 200 illustrated in FIG. 2. As illustrated in FIG. 4, the video playing method may include the following steps:

In step 401, the GPU obtains a target video, the target video including a plurality of video frames arranged in sequence.

Optionally, the display device may include a memory, and the target video may be stored in the memory. The GPU may obtain the target video from the memory. Alternatively, the display device may include a communication component, and the GPU may obtain the target video from the server through the communication component of the display device. Alternatively, the GPU may receive the target video shared by other devices, so as to obtain the target video. It is easy to understand that the manner in which the GPU obtains the target video provided in the embodiments of the present disclosure is merely exemplary, and the manner in which the GPU obtains the target video may be various, which is not repeated in the embodiments of the present disclosure.

In step 402, for each of the video frames in the target video, the GPU renders the video frame.

Optionally, for each of the video frames in the target video, the GPU may render the video frame to obtain a rendered video frame. As the target video includes multiple video frames arranged in sequence, the GPU may render the multiple video frames in the target video in sequence to obtain the multiple rendered video frames arranged in sequence. Then, the GPU may execute the following step 403 to send the multiple rendered video frames to the display module. Alternatively, once the GPU renders one video frame, the GPU may send the rendered video frame to the display module, which is not limited in the embodiments of the present disclosure.

In step 403, the GPU sends the plurality of video frames in the target video to the display module according to the sequence of the video frames arranged in the target video.

Optionally, the GPU may sequentially send the multiple rendered video frames in the target video to the display module according to the sequence of the video frames arranged in the target video. For each of the video frames in the target video, the GPU may send the video frame to the display module, and send the next video frame following the video frame to the display module after a target duration has elapsed from the start moment of sending the video frame.

Optionally, for each of the video frames in the target video, the GPU may send the video frame to the display module, generate a synchronization signal and send synchronization signal to the display module after a target duration has elapsed from the start moment of sending the video frame. The synchronizing signal is used for instructing the display module to receive the next video frame following the video frame. After generating the synchronization signal, the GPU may send the next video frame following the video frame to the display module. For each of the video frames in the target video, the display module can play the video frame while receiving the video frame. For each of the video frames, the target duration may be the duration for which the display module plays the video frame from the start moment of receiving the video frame. The synchronization signal may be a vertical synchronization (V-Sync) signal. The synchronization signal is used to instruct the display module to receive the next video frame following the video frame that is currently being played, and the GPU may conduct a dynamic synchronization control on the display of the display module through the synchronization signal. In the embodiments of the present disclosure, the content of the synchronization signal may be dynamically adjusted according to the content of the video frame and the rendering duration of the video frame by the GPU. It can be readily understood that, for different video frames, the content of the synchronization signal may be generally different, which is not limited in embodiments of the present disclosure.

Optionally, for each of the video frames in the target video, the target duration may be positively correlated to a duration for which the GPU completely sends the video frame to the display module. For example, for each of the video frames in the target video, the target duration is equal to the sum of a fixed duration and the duration for which the GPU completely sends the video frame to the display module. The duration for which the GPU completely sends a certain video frame to the display module is equal to the duration from the start moment of sending the video frame by the GPU to the display module to the moment when the GPU completely sends the video frame to the display module. For different video frames in the target video, the fixed duration may be equal or unequal, which is not limited in the embodiments of the present disclosure.

Hereinafter, the technical process that the GPU sends each of the video frames in the target video to the display module will be briefly described in the embodiments of the present disclosure by taking an example in which the target duration is equal to the sum of a fixed duration and the duration for which the GPU completely sends the video frame to the display module, and the fixed durations are equal for different video frames in the target video.

Figure 5:
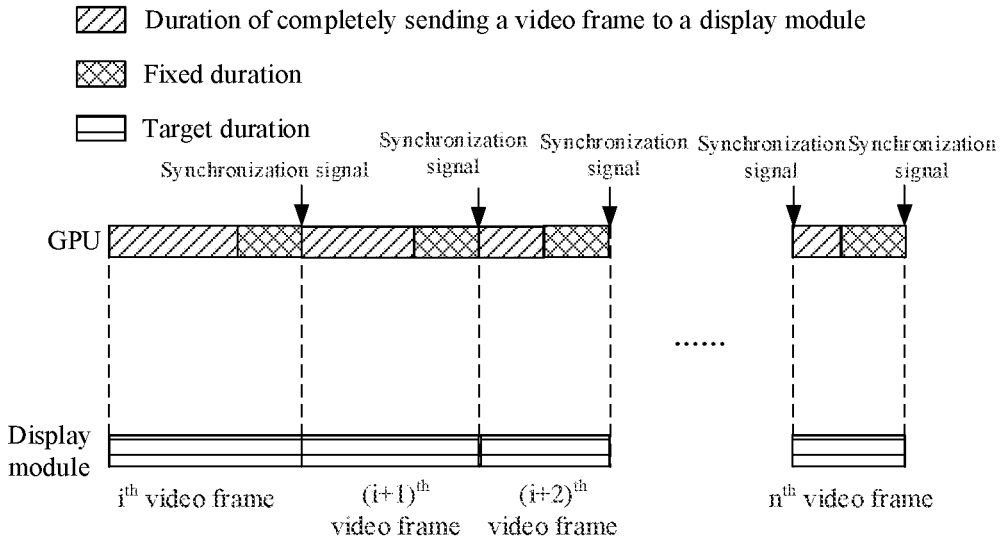
FIG. 5 is a schematic diagram of a video playing method provided in an embodiment of the present disclosure.

FIG. 5 is a schematic diagram of a video playing method provided by an embodiment of the present disclosure. As illustrated in FIG. 5, the target video includes n video frames arranged in sequence, where n is an integer greater than or equal to 3. For each of the video frames in the target video (e.g., the $i^{th}$ video frame), the GPU generates a synchronization signal and send synchronization signal to the display module after the GPU completely sends the video frame to the display module and after a fixed duration has elapsed (i.e., when the target duration ends). The synchronizing signal is used for instructing the display module to receive the next video frame (e.g., the $(i+1)^{th}$ video frame) following the video frame. After generating the synchronizing signal, the GPU may send the next video frame following the video frame to the display module. The GPU may generate another synchronization signal and send it to the display module after the GPU completely sends the next video frame following the video frame to the display module and the same fixed duration has elapsed. The synchronizing signal is used for instructing the display module to receive the further next video frame (i.e., the next one following the next video frame, e.g., the $(i+2)^{th}$ video frame) following the next video frame. Similarly, after generating the another synchronizing signal, the GPU may send the further next video frame (e.g., the $(i+2)^{th}$ video frame) to the display module, and so on. Then, the GPU may generate a further synchronization signal and send it to the display module after the GPU completely sends the further next video frame to the display module and the same fixed duration has elapsed. Thus, after the GPU completely send each of video frames in the target video to the display module, the GPU may wait for the same fixed duration, and after the same fixed duration has elapsed, the GPU sends the next video frame to the display module. In the case that the duration required by the GPU to completely send a certain video frame to the display module is relatively short, the problem that the GPU needs to wait for a long time before sending the next video frame to the display module can be avoided, which can improve the refresh rate of the video. In addition, by means of sending a synchronization signal to the display module by the GPU, for each of video frames, the process of sending the video frame by the GPU to the display module and the process of playing the video frame by the display module can be performed synchronously.

Optionally, the fixed duration may be determined according to the duration of grayscale conversion of the display module. The display module may be a liquid crystal display module or a light emitting diode display module. When the display module is a liquid crystal display module, the fixed duration may be determined according to the duration of gesture transformation of the liquid crystal. When the display module is a light emitting diode display module, the fixed duration may be determined according to the duration of grayscale conversion of the light emitting diode.

When the display module is a liquid crystal display module, after receiving the video frame sent by the GPU, the display module may drive the liquid crystal to perform gesture transformation according to the video frame, so as to play the video frame by using the gesture change of the liquid crystal. Thus, after the GPU completely sends the video frame to the display module, the GPU needs to wait for a fixed duration before sending the next video frame to the display module. The fixed duration is longer than the duration required by the liquid crystal to perform gesture transformation, so as to ensure that the liquid crystal molecules in display module have sufficient time to perform gesture transformation, thereby ensuring the normal play of video frames. When the display module is a light emitting diode display module, after receiving a video frame sent by the GPU, the display module may drive the light emitting diodes to emit light according to the video frame, so as to play the video frame by using the brightness change of the light emitting diodes, Thus, after the GPU completely sends the video frame to the display module, the GPU needs to wait for a fixed duration before sending the next video frame to the display module. The fixed duration is longer than the duration required by the light emitting diodes to perform grayscale conversion, so as to ensure that the light emitting diodes in the display module have sufficient time to perform the grayscale conversion, thereby ensuring the normal playing of video frames.

In step 404, for each of the video frames in the target video, the display module receives the video frame sent by the GPU and plays the video frame for a target duration from the start moment of receiving the video frame. The target durations for which the display module plays at least two video frames in the target video are not equal.

As described above, for each of the video frames in the target video, the target duration may be positively correlated to a duration for which the GPU completely sends the video frame to the display module. Since the durations respectively required by the GPU to completely send different video frames to the display module are generally not equal to each other, the target duration is generally not equal to each other for different video frames in the target video. In other words, the target durations for which the display module plays at least video frames in the target video are not equal to each other.

In the embodiments of the present disclosure, for each of the video frames in the target video, the display module may receive a synchronization signal sent by the GPU during play of the video frame. The synchronization signal is sent to the display module by the GPU after a target duration has elapsed from the start moment of sending the video frame. After receiving the synchronization signal, the display module may receive the next video frame following the video frame sent by the GPU, and play the next video frame for the target duration from the start moment of receiving the next video frame.

Hereinafter, the technical process that the display module plays each of the video frames in the target video will be briefly described in the embodiments of the present disclosure by taking an example in which the target duration is equal to the sum of a fixed duration and the duration for which the GPU completely sends the video frame to the display module, and the fixed durations are equal for different video frames in the target video.

Please continue to refer to FIG. 5. As illustrated in FIG. 5, for each of the video frames in the target video (e.g., the $i^{th}$ video frame), during the process of playing the video frame, the display module may receive a synchronization signal sent by the GPU after the GPU completely sends the video frame to the display module and a fixed duration has elapsed. After receiving the synchronization signal, the display module may stop playing the video frame, and receives the next video frame (e.g., the $(i+1)^{th}$ video frame) following the video frame sent by the GPU. At the same time, the display module may play the next video frame from the moment of receiving the synchronization signal sent by the GPU (that is, from the start moment of receiving the next video frame). During the process of playing the next video frame, the display module may receive another synchronization signal sent by the GPU after the GPU completely sends the next video frame to the display module and a fixed duration has elapsed. After receiving the another synchronization signal, the display module may stop playing the next video frame, and receives a further next video frame (e.g., the $(i+2)^{th}$ video frame) of the video frame sent by the GPU. Similarly, the display module may play the further next video frame from the moment of receiving the another synchronization signal (that is, from the start moment of receiving the further next video frame), and so on. During the process of playing the further next video frame, the display module may receive a further synchronization signal sent by the GPU after the GPU completely sends the further next video frame to the display module and the same fixed duration has elapsed, and the display module may stop playing the further next video frame after receiving the further synchronization signal.

It can be seen from the above description that, the duration for which the display module plays a certain video frame is the sum of a fixed duration and the duration for which the GPU completely sends the video frame to the display module. In this way, when the duration required by the GPU to send a certain video frame to the display module is relatively short, the duration (that is, the target duration) for which the display module plays the video frame is also relatively short, which can reduce the average duration of playing the video frames by the display module Thus, compared with the video playing method known by the inventor, the display module can display more video frames in the same duration. Thus, the refresh rate of the video can be improved.

Figure 6:
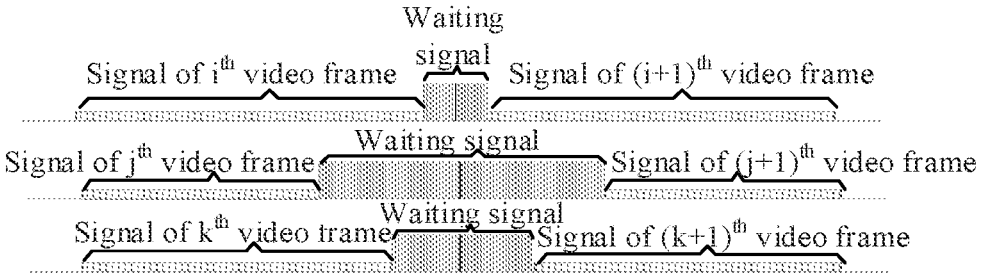
FIG. 6 is a schematic diagram of outputting signals by a GPU in the technology known by the inventor.
Figure 7:
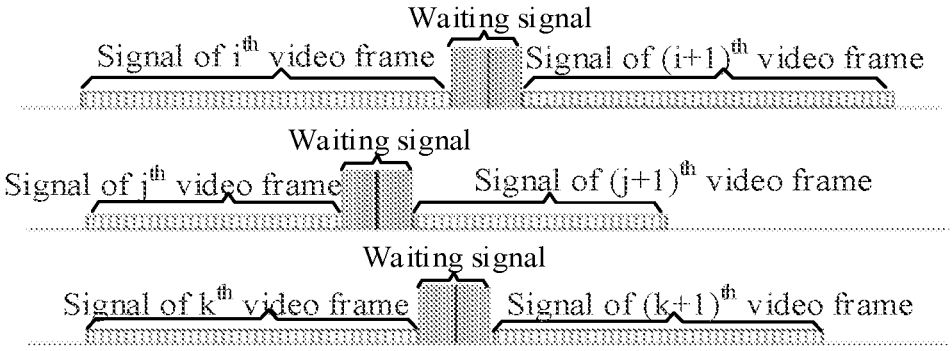
FIG. 7 is a schematic diagram of outputting signals by a GPU in a video playing method provided in an embodiment of the present disclosure.

Please refer to FIG. 6 and FIG. 7. FIG. 6 is a schematic diagram of outputting signals by a GPU in the video playing method known by the inventor, and FIG. 7 is a schematic diagram of outputting signal by a GPU in a video playing method provided in the embodiments of the present disclosure. In FIG. 6 and FIG. 7, the waiting signal refers to the signal output by the GPU when the GPU waits between sending two adjacent video frames to the display module. As shown in FIG. 6, in the video playing method known by the inventor, the durations for which the GPU completely sends different video frames to the display module are different from each other, the durations for which the GPU respectively waits between sending adjacent video frames are different from each other, and the durations for which the display module respectively plays different video frames are the same. As shown in FIG. 7, in the video playing method provided in the embodiments of the present disclosure, the durations for which the GPU respectively completely sends different video frames to the display module are different from each other, and the durations for which the GPU waits between sending adjacent video frames are the same. Therefore, the durations for which the display module respectively plays different video frames may be different from each other. By comparing FIG. 6 and FIG. 7, it is easy to understand that in the video playing method provided in the embodiments of the present disclosure, the display module can play more video frames in the same duration. Thus, the refresh rate of the video can be improved.

Persons in the art can readily understand that the sequence of steps described in the embodiments of the present disclosure is not intended to limit the sequence of steps executed by the GPU and the display module. That is, in the embodiments of the present disclosure, the steps described earlier can be executed later, or the steps described later can be executed earlier, or the steps described earlier and the steps described later can be executed simultaneously or cross-executed, which is not limited in the embodiments of the present disclosure.

In summary, with the video playing method provided in the embodiments of the present disclosure, the GPU obtains the target video and sends sequentially a plurality of video frames arranged in sequence in the target video to the display module, and for each of the video frames, the display module receives the video frame and plays the video frame for a target duration from the start moment of receiving the video frame. The target durations for which the display module plays at least two video frames in the target video are not equal to each other. In this way, the playing duration for one or more video frames in the target video by the display module can be relatively short. Compared with the video playing method known by the inventor, the display module can display more video frames in the same duration. Thus, the refresh rate of the video can be improved.

The video playing method provided in embodiments of the present disclosure can be applied to various display devices, and is particularly applicable for VR head-mounted displays. When the video playing method is applied to head-mounted displays, motion sickness can be avoided for users.

Figure 8:
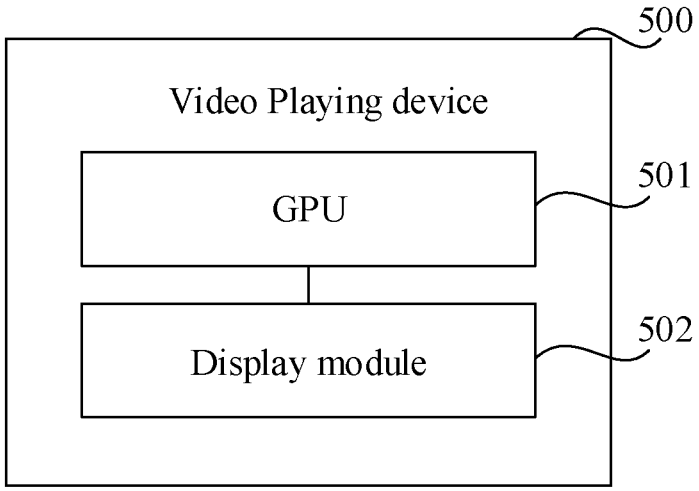
FIG. 8 is a block diagram of a video playing device provided in an embodiment of the present disclosure.

Please refer to FIG. 8, which illustrates a block diagram of a video playing device 500 provided by an embodiment of the present disclosure. As illustrated in FIG. 8, the video playing device 500 may be a display device, and the video playing device 500 may include a GPU 501 and a display module 502.

The GPU 501 is configured to obtain a target video which includes a plurality of video frames arranged in sequence, and to send sequentially the plurality of video frames to the display module 502.

The display module 502 is configured to, for each of the video frames, receive the video frame and play the video frame for a target duration from the start moment of receiving the video frame, wherein the target durations for which the display module 502 plays at least two video frames in the target video are not equal to each other.

In an embodiment of the present disclosure, for each of the video frames, the target duration is positively correlated to a duration for which the GPU 502 completely sends the video frame to the display module 502.

In an embodiment of the present disclosure, for each of the video frames, the target duration is equal to the sum of a fixed duration and the duration for which the GPU 501 completely sends the video frame to the display module 502, and the fixed durations are equal for the multiple video frames.

In an embodiment of the present disclosure, the GPU 501 is configured to, for each of the video frames, send the video frame to the display module 502, and send the next video frame following the video frame to the display module 502 after the target duration has elapsed from the start moment of sending the video frame.

In an embodiment of the present disclosure, the GPU 501 is configured to, for each of the video frames, send the video frame to the display module 502, and send the next video frame following the video frame to the display module 502 when a fixed duration has elapsed from the moment when the video frame is completely sent to the display module 502.

In an embodiment of the present disclosure, the GPU 501 is further configured to, for each of the video frames, generate a synchronization signal and send the synchronization signal to the display module 502 after the target duration has elapsed from the start moment of sending the video frame. The synchronization signal is configured to instruct the display module 502 to receive the next video frame following the video frame and to play the next video frame for the target duration from the start moment of receiving the next video frame.

In an embodiment of the present disclosure, the display module 502 is further configured to, for each of the video frames, receive the next video frame following the video frame after receiving the synchronization signal, and play the next video frame for the target duration from the start moment of receiving the synchronization signal.

In an embodiment of the present disclosure, the target duration is equal to a sum of a fixed duration and a duration for which the GPU 501 completely sends the video frame to the display module 502; and when the display module 502 is a liquid crystal display module, the fixed duration is determined according to the duration of the gesture transformation of the liquid crystal.

In an embodiment of the present disclosure, the target duration is equal to a sum of a fixed duration and a duration for which the GPU 501 completely sends the video frame to the display module 502; and when the display module 502 is a light emitting diode display module, the fixed duration is determined according to the duration of the grayscale conversion of the light emitting diode.

In an embodiment of the present disclosure, the GPU 501 is further configured to, for each of the video frames, render the video frame, and sequentially send the plurality of rendered video frames to the display module 502.

In summary, the video playing device provided in the embodiments of the present disclosure includes a GPU and a display module. The GPU obtains the target video and sequentially sends the plurality of video frames arranged in sequence in the target video to the display module. For each of the video frames, the display module receives the video frame and plays the video frame for a target duration from the start moment of receiving the video frame. The target durations for which the display module plays at least two video frames in the target video are not equal to each other. In this way, the playing duration for one or more video frames in the target video by the display module can be relatively short. Compared with the video playing method known by the inventor, the display module can display more video frames in the same duration. Thus, the refresh rate of the video can be improved.

In the embodiments of the present disclosure, the division of the above described functional modules is merely taken as an example for description when the video playing device provided in the above described embodiment plays a video. Those skilled in the art can easily understand that the functions described above can be completed by different functional modules as needed, that is, the internal structure of the video playing device can be divided into different functional modules to complete all or part of the functions described above. Further, the video playing device and the video playing method provided in the above described embodiments follow the same concept. For details of the implementing processes of the embodiments of the video playing device, reference may be made to the embodiments of the method and are not repeated here.

Based on the same inventive concept, embodiments of the present disclosure further provide a display device. The display device may include a display module and a GPU, and the display module and the GPU may establish a communication connection therebetween, such as a bus connection or the like. The display device may be any product or component having a display function, such as a television, a display, a VR head-mounted display, a smart phone, a tablet computer, a piece of electronic paper, a watch, a bracelet, a notebook computer, a digital photo frame, or a navigator.

The display module may be a liquid crystal display module or an electroluminescent display module. The electroluminescent display module may be, for example, an Organic Light Emitting Diode (OLED) display module or a Quantum Dot Light Emitting Diode (QLED) display module. The display module is configured to implement the technical process performed by the display module in the above described embodiments.

The GPU is configured to implement the technical process performed by the GPU in the above described embodiments.

The display module may include a display panel and a driving circuit configured to drive the display panel. The driving circuit may include a timing controller, a gate driving circuit, and a source driving circuit. The gate driving circuit is configured to scan rows of pixel units in the display panel row by row according to the video frame sent by the GPU, the source driving circuit is configured to provide data signals for columns of pixel units in the display panel according to the video frame sent by the GPU, and the timing controller is connected to the gate driving circuit and the source driving circuit and is configured to control the gate driving circuit and the source driving circuit.

An embodiment of the present disclosure further provides a computer-readable storage medium. The computer-readable medium stores a computer program, and the computer program, when executed, can implement the video playing method provided in the above described embodiments of the present disclosure. The computer-readable storage medium may be a non-transitory storage medium, and the computer program may be one or more instructions, one or more programs, a code set, an instruction set, or the like.

An embodiment of the present disclosure further provides a computer program product. The computer program product stores instructions that, when executed in a computer, cause the computer to implement the video playing method provided in the above described embodiments of the present disclosure.

An embodiment of the present disclosure further provides a chip that includes a programmable logic circuit and/or program instructions. The chip, when running, can implement the video playing method provided in the above described embodiments of the present disclosure.

The term "and/or" merely describes the correspondence of the corresponding objects, and indicates three kinds of relationship. For example, A and/or B can be expressed as: A exists alone, A and B exist concurrently, and B exists alone. In addition, the character "/" in the embodiments of the present disclosure generally indicates an "OR" relationship of the corresponding objects.

The term "at least two" in the embodiments of the present disclosure refers to two or more.

Persons of ordinary skill in the art can understand that all or part of the steps described in the above embodiments can be completed through hardware, or through relevant hardware instructed by programs stored in a computer readable storage medium, such as a read-only memory, a disk or a CD, etc.

The foregoing descriptions are merely optional embodiments of the present disclosure, and are not intended to limit the present disclosure. Within the spirit and principles of the present disclosure, any modifications, equivalent substitutions, improvements, etc., are within the protection scope of the present disclosure.

What is claimed is:

1. A video playing method, comprising:

obtaining a target video by a graphics processing unit, the target video comprising a plurality of video frames arranged in sequence;

sending sequentially the plurality of video frames to a display module by the graphics processing unit; and for each of the video frames, receiving the video frame and playing the video frame for a target duration from a start moment of receiving the video frame, by the display module;

wherein target durations for which the display module plays at least two video frames in the target video are not equal; and wherein for each of the video frames, the target duration is equal to a sum of a fixed duration and the duration for which the graphics processing unit completely sends the video frame to the display module, the fixed duration being equal for the plurality of video frames.

2. The method according to claim 1, wherein for each of the video frames, the target duration is positively correlated to a duration for which the graphics processing unit completely sends the video frame to the display module.

3. The method according to claim 1, wherein sending sequentially the plurality of video frames to the display module by the graphics processing unit comprises:

for each of the video frames, sending the video frame to the display module by the graphics processing unit, and sending a next video frame following the video frame to the display module by the graphics processing unit after the target duration has elapsed from a start moment of sending the video frame.

4. The method according to claim 3, wherein, for each of the video frames, sending the video frame to the display module by the graphics processing unit, and sending the next video frame following the video frame to the display module by the graphics processing unit after the target duration has elapsed from the start moment of sending the video frame comprises:

for each of the video frames, sending the video frame to the display module by the graphics processing unit, and sending the next video frame following the video frame to the display module by the graphics processing unit when a fixed duration has elapsed from a moment when the video frame is completely sent to the display module.

5. The method according to claim 3, further comprising:

for each of the video frames, after the target duration has elapsed from the start moment of sending the video frame, generating a synchronization signal and sending the synchronization signal to the display module by the graphics processing unit, the synchronization signal being configured to instruct the display module to receive the next video frame following the video frame and to play the next video frame for the target duration from a start moment of receiving the next video frame.

6. The method according to claim 5, further comprising:

for each of the video frames, receiving, by the display module, the next video frame after receiving the synchronization signal, and playing, by the display module, the next video frame for the target duration from a moment of receiving the synchronization signal.

7. The method according to claim 1, wherein when the display module is a liquid crystal display module, the fixed duration is determined according to a duration of gesture transformation of a liquid crystal.

8. The method according to claim 1, wherein when the display module is a light emitting diode display module, the fixed duration is determined according to a duration of grayscale conversion of a light emitting diode.

9. The method according to claim 1, wherein prior to sending sequentially the plurality of video frames to the display module by the graphics processing unit, the method further comprises: for each of the video frames, rendering the video frame by the graphics processing unit; and sending sequentially the plurality of video frames to the display module by the graphics processing unit comprises: sending sequentially the plurality of rendered video frames to the display module by the graphics processing unit.

10. A video playing device, comprising a graphics processing unit and a display module, wherein the graphics processing unit is configured to obtain a target video which comprises a plurality of video frames arranged in sequence, and send sequentially the plurality of video frames to the display module; and the display module is configured to, for each of the video frames, receive the video frame and play the video frame for a target duration from a start moment of receiving the video frame;

wherein target durations for which the display module plays at least two video frames in the target video are not equal; and wherein for each of the video frames, the target duration is equal to a sum of a fixed duration and the duration for which the graphics processing unit completely sends the video frame to the display module, and the fixed duration is equal for the plurality of video frames.

11. The device according to claim 10, wherein for each of the video frames, the target duration is positively correlated to a duration for which the graphics processing unit completely sends the video frame to the display module.

12. The device according to claim 10, wherein the graphics processing unit is configured to, for each of the video frames, send the video frame to the display module, and send a next video frame following the video frame to the display module after the target duration has elapsed from a start moment of sending the video frame.

13. The device according to claim 12, wherein the graphics processing unit is configured to, for each of the video frames, send the video frame to the display module, and send the next video frame following the video frame to the display module when a fixed duration has elapsed from a moment when the video frame is completely sent to the display module.

14. The device according to claim 12, wherein the graphics processing unit is further configured to, for each of the video frames, after the target duration has elapsed from the start moment of sending the video frame, generate a synchronization signal and send the synchronization signal to the display module, the synchronization signal being configured to instruct the display module to receive the next video frame following the video frame and to play the next video frame for the target duration from a start moment of receiving the next video frame.

15. The device according to claim 14, wherein the display module is further configured to, for each of the video frames, receive the next video frame after receiving the synchronization signal, and play the next video frame for the target duration from a start moment of receiving the synchronization signal.

16. The device according to claim 10, wherein when the display module is a liquid crystal display module, the fixed duration is determined according to a duration of the gesture transformation of a liquid crystal, and when the display module is a light emitting diode display module, the fixed duration is determined according to a duration of grayscale conversion of a light emitting diode.

17. The device according to claim 10, wherein the graphics processing unit is further configured to, for each of the video frames, render the video frame, and sequentially send the plurality of rendered video frames to the display module.

18. A non-transitory computer-readable storage medium, wherein a computer program is stored in the computer-readable storage medium, and the computer program, when executed, performs a video playing method, comprising:

obtaining a target video by a graphics processing unit, the target video comprising a plurality of video frames arranged in sequence;

sending sequentially the plurality of video frames to a display module by the graphics processing unit; and for each of the video frames, receiving the video frame and playing the video frame for a target duration from a start moment of receiving the video frame, by the display module;

wherein target durations for which the display module plays at least two video frames in the target video are not equal; and wherein for each of the video frames, the target duration is equal to a sum of a fixed duration and the duration for which the graphics processing unit completely sends the video frame to the display module, the fixed duration being equal for the plurality of video frames.

* * * * *